US010843369B2

(12) United States Patent
Sarius et al.

(10) Patent No.: US 10,843,369 B2
(45) Date of Patent: Nov. 24, 2020

(54) LIGHTWEIGHT CHAINSAW GUIDE BAR

(71) Applicant: HUSQVARNA AB, Huskvarna (SE)

(72) Inventors: Niklas Sarius, Jönköping (SE); Christian Liliegård, Jönköping (SE); Jörgen Johansson, Jönköping (SE)

(73) Assignee: HUSQVARNA AB, Huskvarna (SE)

( * ) Notice: Subject to any disclaimer, the term of this patent is extended or adjusted under 35 U.S.C. 154(b) by 0 days.

(21) Appl. No.: 16/092,118

(22) PCT Filed: Apr. 5, 2017

(86) PCT No.: PCT/EP2017/058067
§ 371 (c)(1),
(2) Date: Oct. 8, 2018

(87) PCT Pub. No.: WO2017/174633
PCT Pub. Date: Oct. 12, 2017

(65) Prior Publication Data

US 2019/0118404 A1 Apr. 25, 2019

Related U.S. Application Data

(60) Provisional application No. 62/319,966, filed on Apr. 8, 2016.

(51) Int. Cl.
*B27B 17/02* (2006.01)

(52) U.S. Cl.
CPC ..... *B27B 17/025* (2013.01)

(58) Field of Classification Search
CPC ..... B27B 17/025
See application file for complete search history.

(56) References Cited

U.S. PATENT DOCUMENTS 3,473,581 A * 10/1969 Max ..... B27B 17/025 30/387
3,545,505 A 12/1970 DeWesse et al.
4,393,590 A 7/1983 Pantzar
4,961,263 A * 10/1990 Apfel ..... B27B 17/025 30/383
5,014,435 A * 5/1991 Date ..... B27B 17/025 30/383
5,067,243 A * 11/1991 O'Neel ..... B27B 17/025 264/46.5

(Continued)

FOREIGN PATENT DOCUMENTS

EP 0 333 354 A1 9/1989

OTHER PUBLICATIONS

International Search Report and Written Opinion for International Application No. PCT/EP2017/058067 dated Jun. 21, 2017.

(Continued)

*Primary Examiner* — Hwei-Siu C Payer
(74) *Attorney, Agent, or Firm* — Burr & Forman, LLP

(57) ABSTRACT

A chainsaw (100) includes a power unit and a working assembly powered responsive to operation of the power unit. The working assembly includes a guide bar (120) around which a chain is rotatable. The guide bar (120) includes a laminated structure in which different ones of the layers of the laminated structure are comprised of different materials.

7 Claims, 12 Drawing Sheets

(56) References Cited

U.S. PATENT DOCUMENTS

| | | | | |
|---|---|---|---|---|
| 5,271,157 | A * | 12/1993 | Wieninger | B27B 17/025 30/383 |
| 5,666,733 | A * | 9/1997 | Nitschmann | B27B 17/025 30/383 |
| 6,427,342 | B1 * | 8/2002 | Breitbarth | B27B 17/025 30/383 |
| 8,661,695 | B2 * | 3/2014 | Hermansen | B27B 17/025 30/383 |
| 9,272,438 | B2 * | 3/2016 | Amend | B27B 17/025 |
| 2014/0250701 | A1 | 9/2014 | Amend et al. | |
| 2018/0036901 | A1 * | 2/2018 | Tsumura | B27B 17/025 |
| 2019/0118404 | A1 * | 4/2019 | Sarius | B27B 17/025 |
| 2019/0134844 | A1 * | 5/2019 | Sarius | B27B 17/025 |

OTHER PUBLICATIONS

International Preliminary Report on Patentability for International Application No. PCT/EP2017/058067 dated Oct. 9, 2018.

* cited by examiner

LIGHTWEIGHT CHAINSAW GUIDE BAR

TECHNICAL FIELD

Example embodiments generally relate to hand held power equipment and, more particularly, relate to a guide bar improvements for a chainsaw.

BACKGROUND

Chainsaws are commonly used in both commercial and private settings to cut timber or perform other rigorous cutting operations. Because chainsaws are typically employed in outdoor environments, and the work they are employed to perform often inherently generates debris, chainsaws are typically relatively robust hand held machines. They can be powered by gasoline engines or electric motors (e.g., via batteries or wired connections) to turn a chain around a guide bar at relatively high speeds. The chain includes cutting teeth that engage lumber or another medium in order to cut the medium as the teeth are passed over a surface of the medium at high speed.

Given that the chainsaw may be employed to cut media of various sizes, the length of the guide bar can be different for different applications. However, in most situations, the guide bar is relatively long, and may actually be substantially longer than the main body of the chainsaw. The guide bar is typically made of steel, and thus, the guide bar can be a substantial contributor to the overall weight of the chainsaw.

Reducing the weight of the chainsaw can allow it to be more easily controlled and carried for long periods of time. However, weight is not the only concern or point of possible improvement in relation to guide bar design. As such, it may be desirable to explore a number of different guide bar design improvements that could be employed alone or together to improve overall chainsaw performance.

BRIEF SUMMARY OF SOME EXAMPLES

Some example embodiments may provide for a guide bar constructed with laminate cores of different types of materials, including some lighter (non-metallic) materials that can be joined together to incorporate various improvements. In some cases, steel may be strategically employed only where needed (e.g., at wear locations or other locations where strength is necessary), so that lighter materials can be employed in other areas. In some cases, lighter materials (e.g., carbon fiber or other materials) may form laminate structures that may be woven together to improve strength and prevent delaminating of the core laminates. In some cases, a heat barrier may be employed to prevent or inhibit heat transfer from the chainsaw to the guide bar. Other improvements may also be possible, and the improvements can be made completely independent of each other, or in combination with each other in any desirable configuration. Accordingly, the operability and utility of the chainsaw may be enhanced or otherwise facilitated.

In an example embodiment, a chainsaw or chainsaw guide bar may be provided. The chainsaw of an example embodiment may include a power unit and a working assembly powered responsive to operation of the power unit. The working assembly includes a guide bar around which a chain is rotatable. The guide bar includes a laminated structure in which different ones of the layers of the laminated structure are comprised of different materials.

BRIEF DESCRIPTION OF THE SEVERAL VIEWS OF THE DRAWINGS

Figure 1:
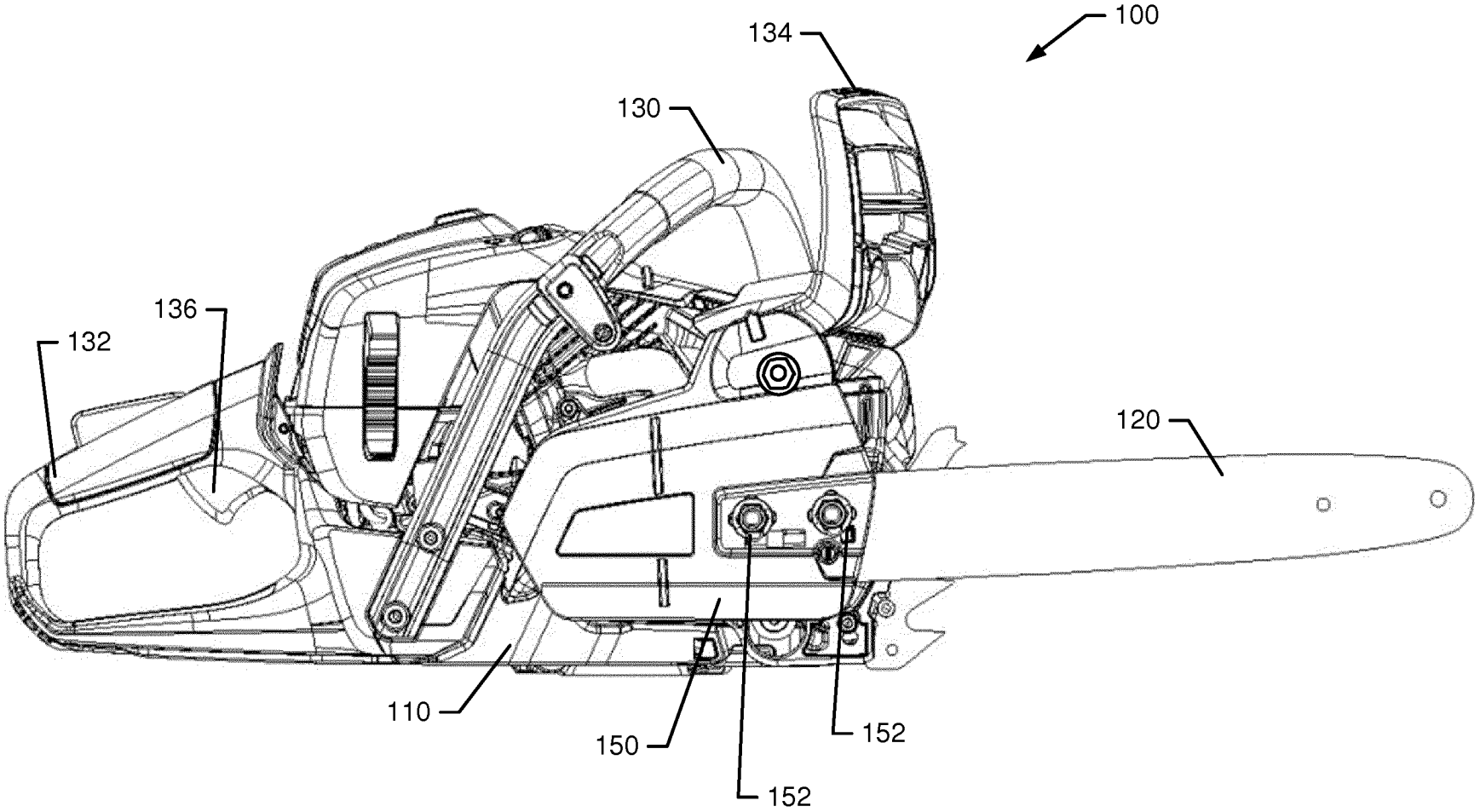
Figure 2:
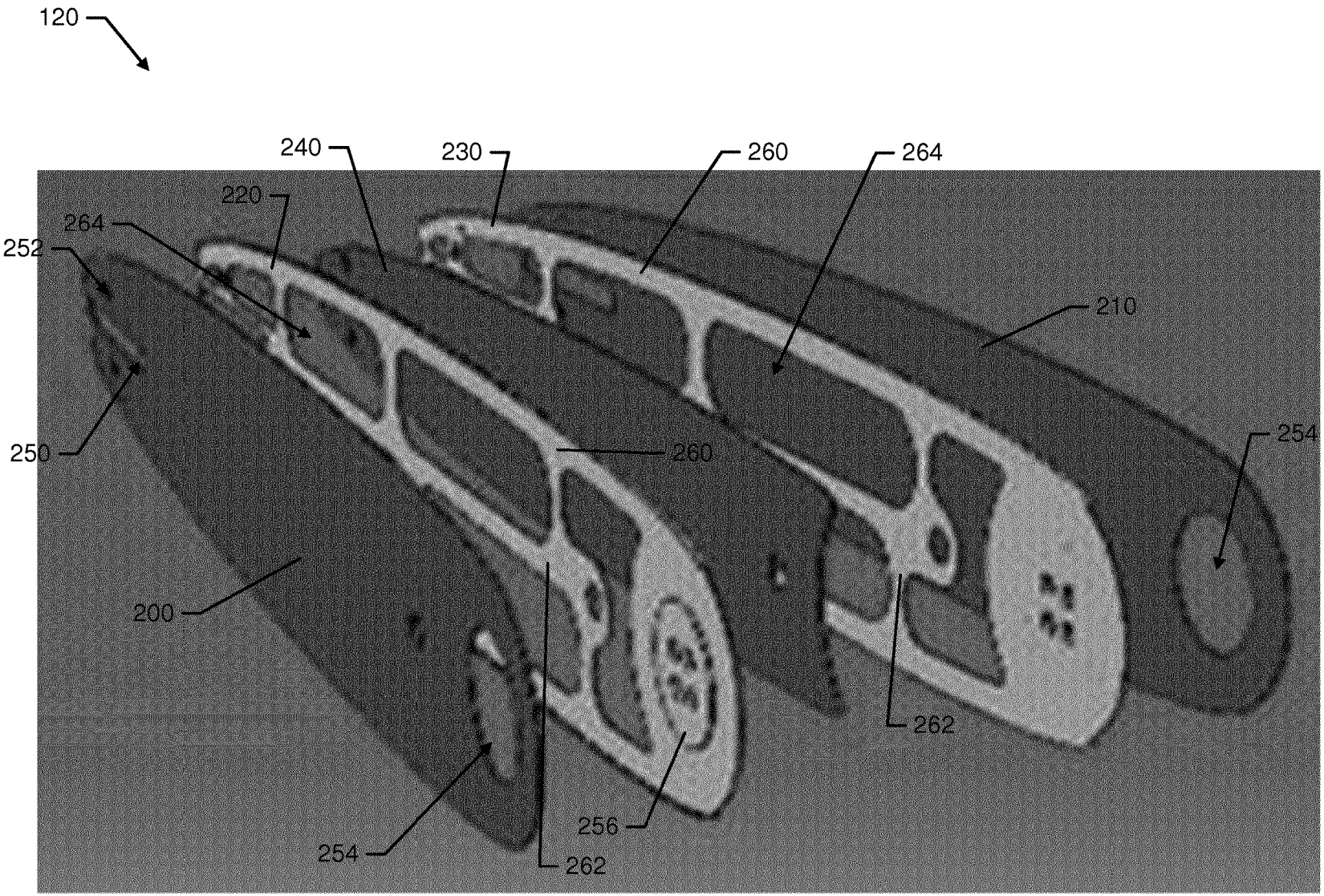
Figure 3:
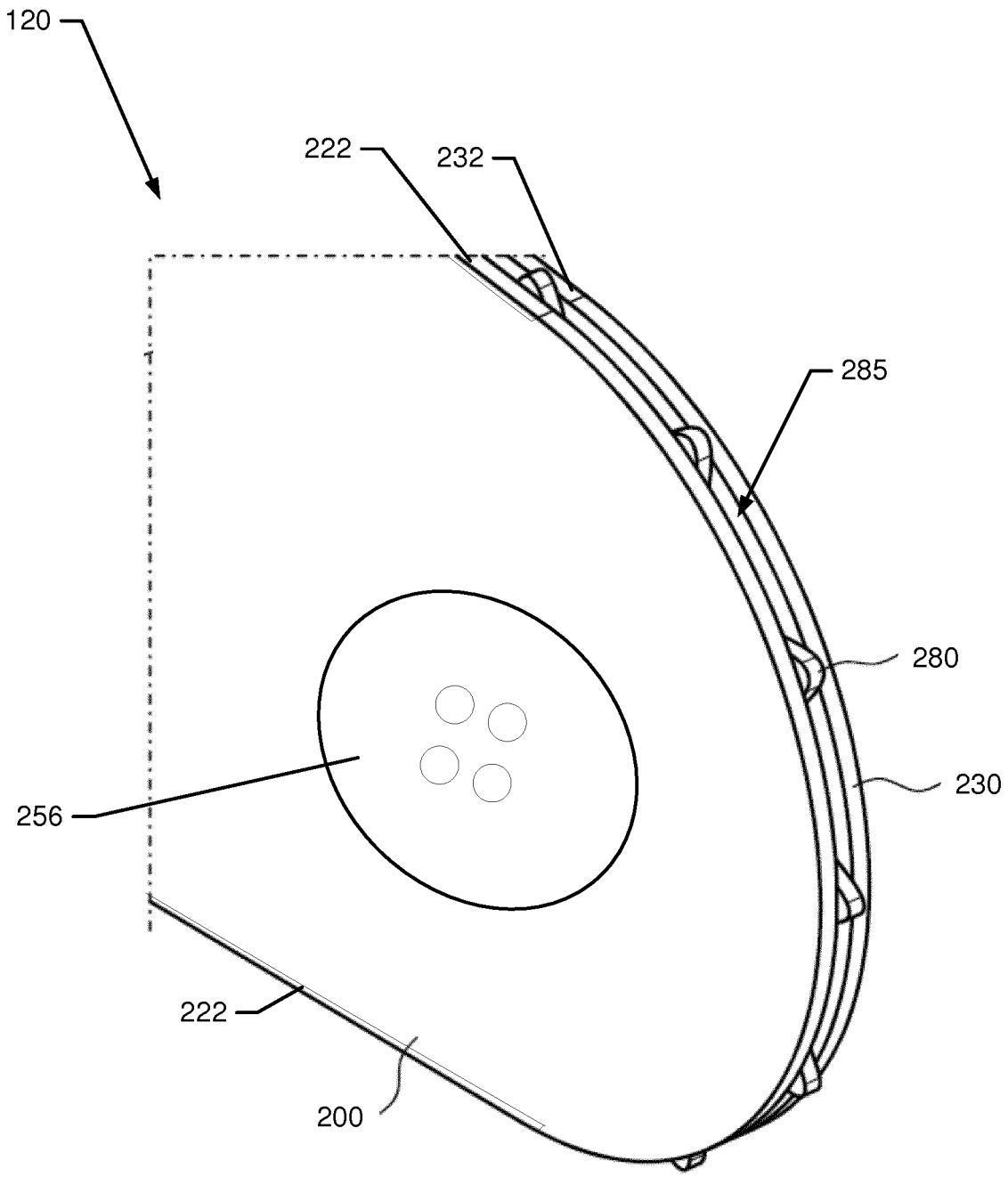
Figure 4A:
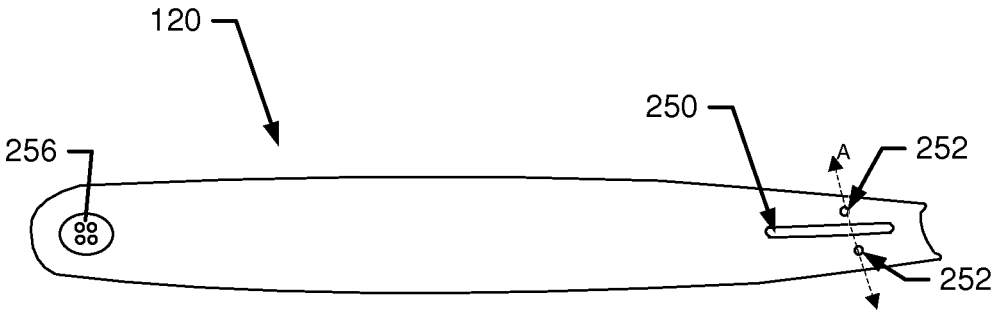
Figures 4B, 4C:
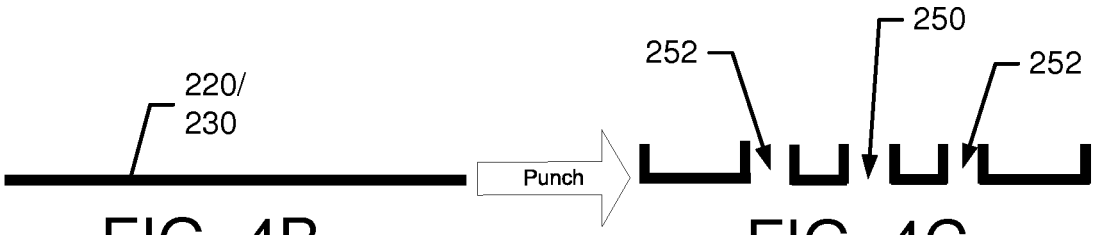
Figure 5A:
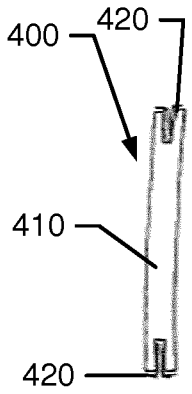
Figure 5B:
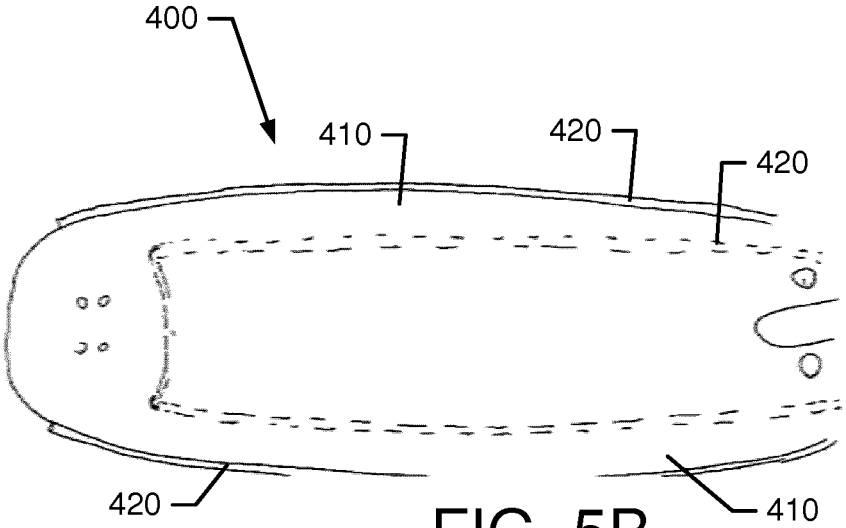
Figure 6A:
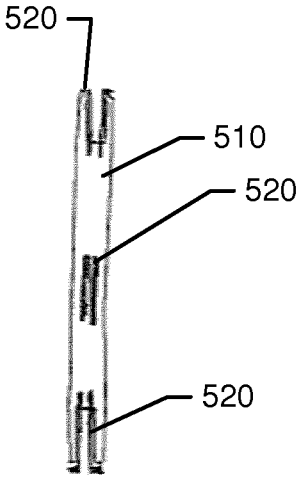
Figure 6B:
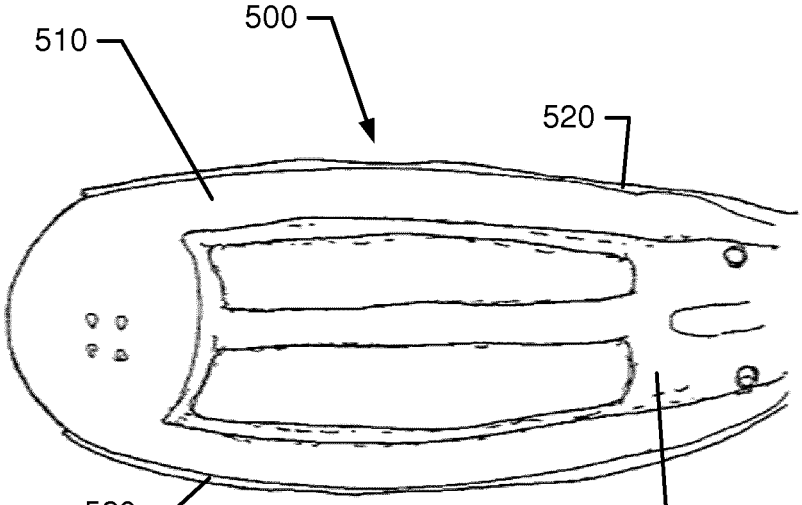
Figure 7:
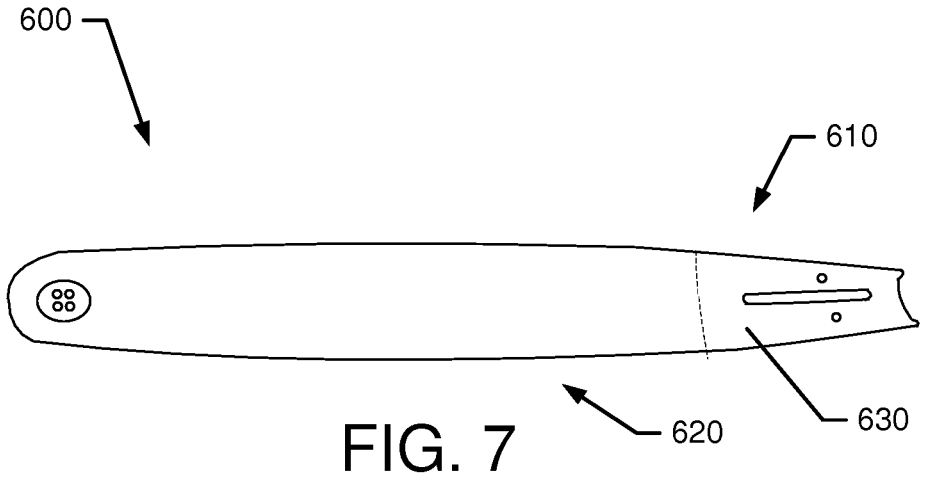
Figure 8:
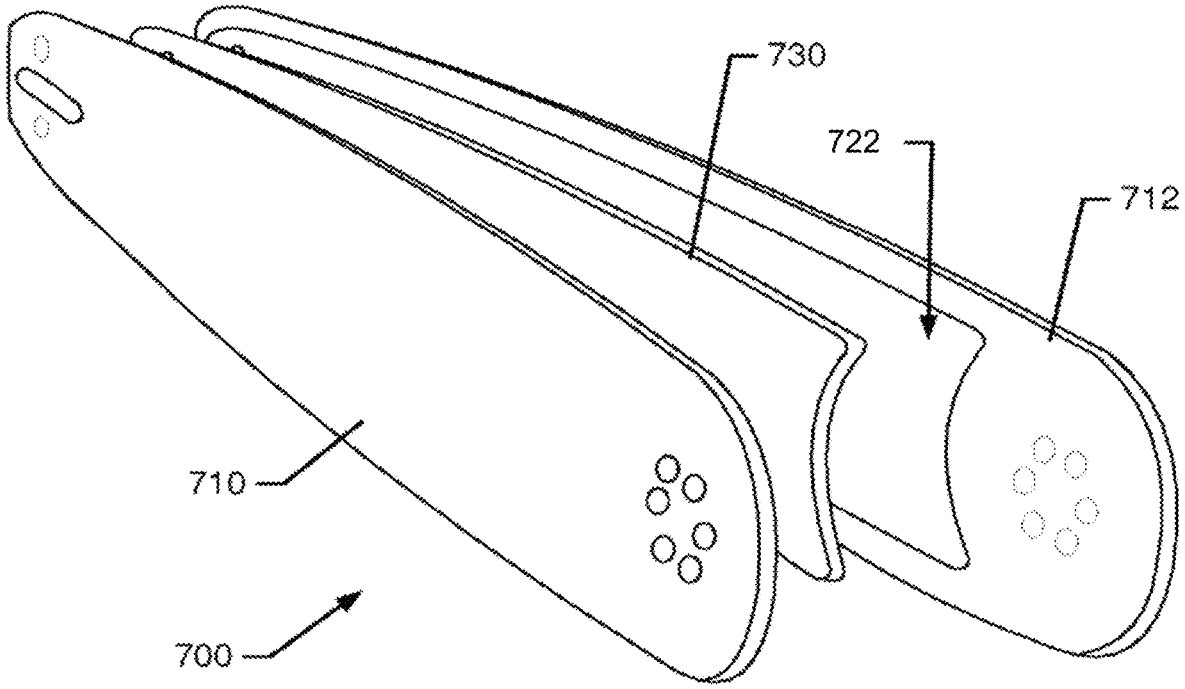
Figure 9A:
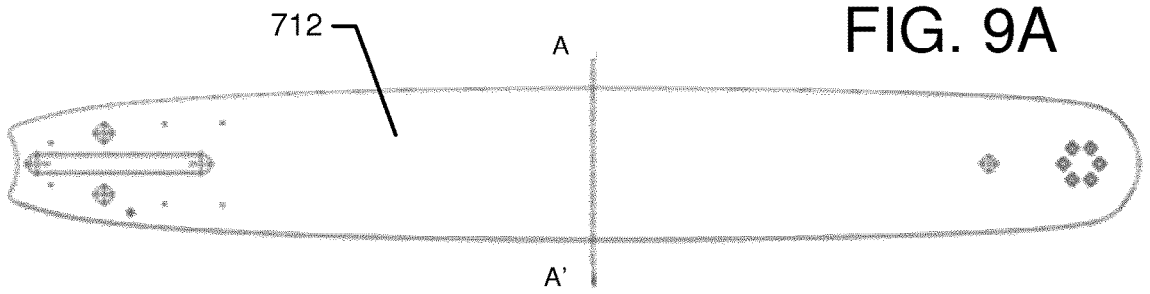
Figure 9B:
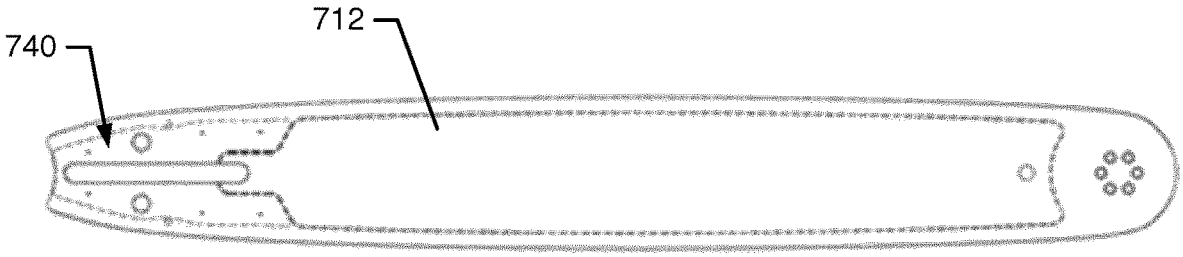
Figure 9C:
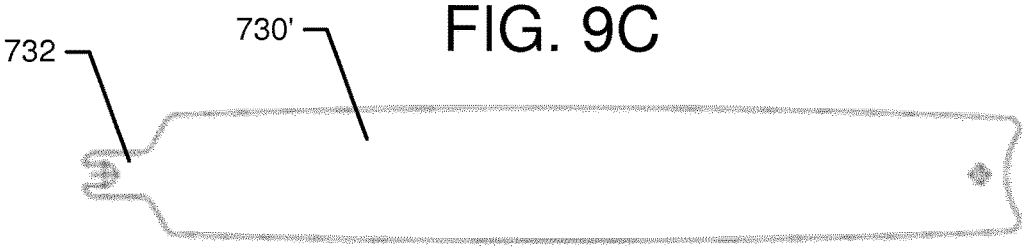
Figure 9D:
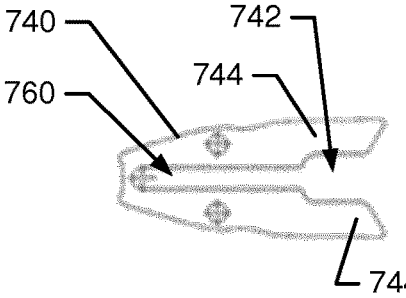
Figure 9E:
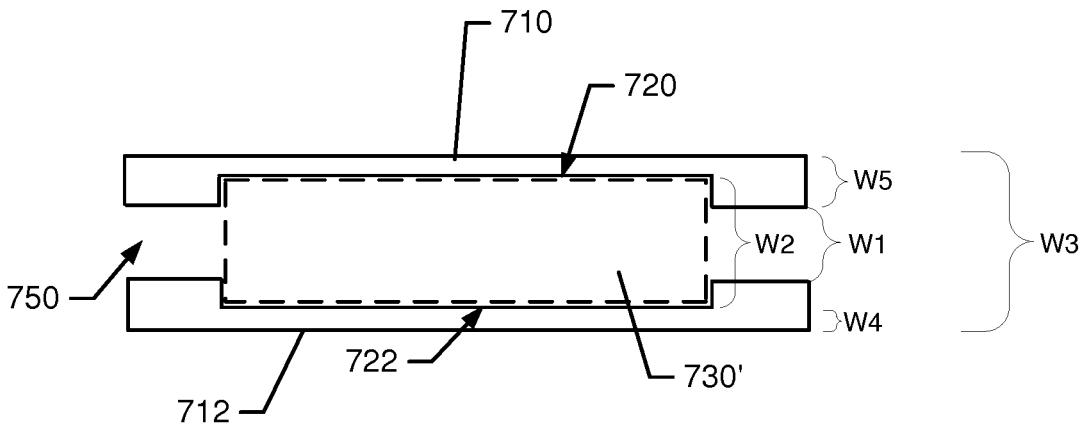
Figure 9F:
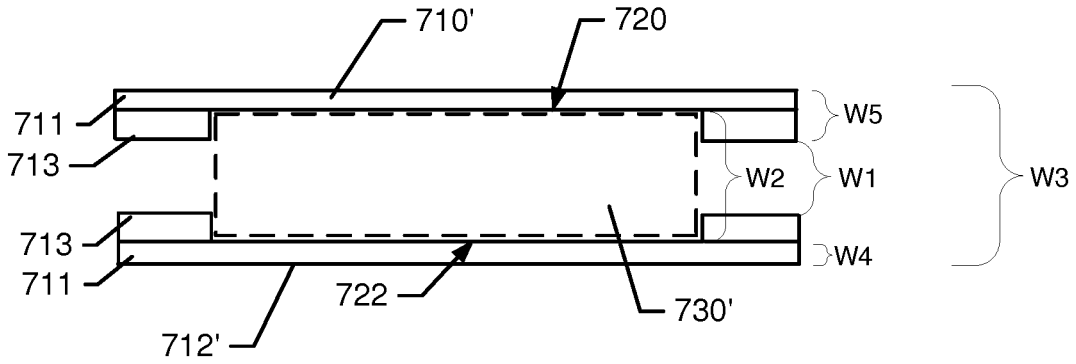
Figure 9G:
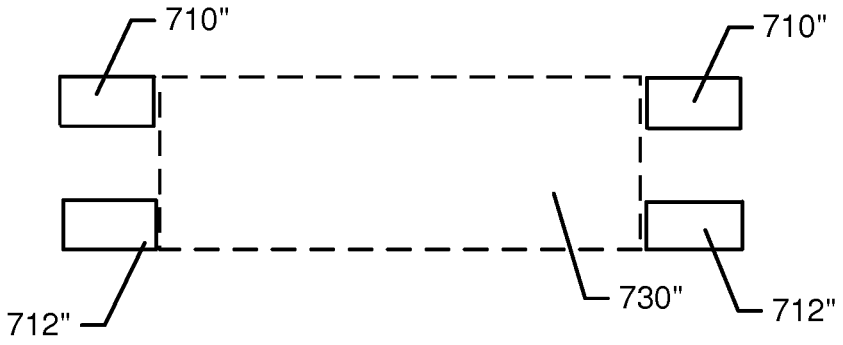
Figure 10A:
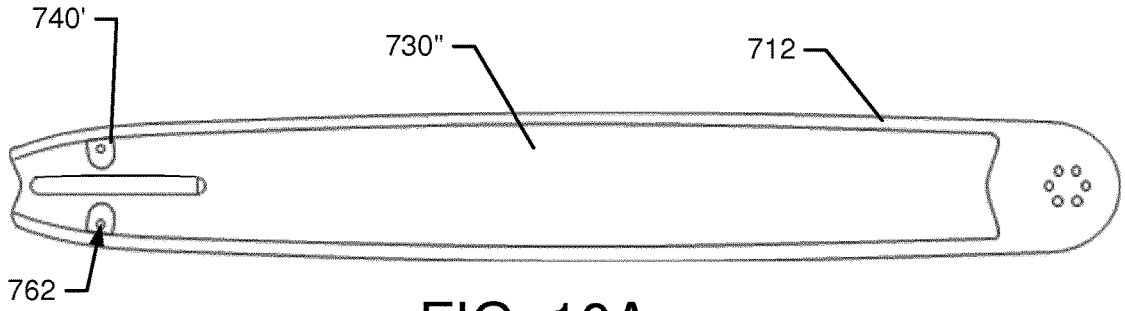
Figure 10B:
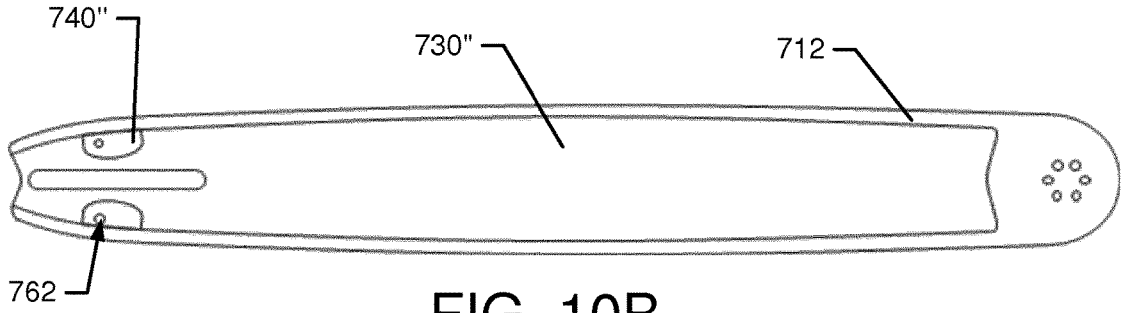
Figure 10C:
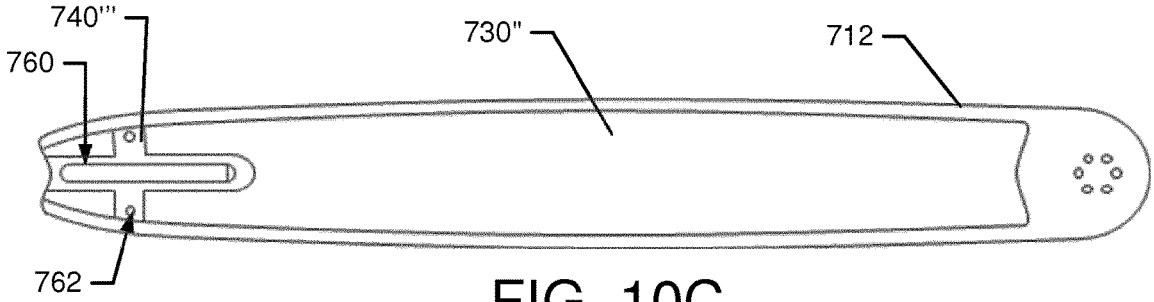
Figure 11A:
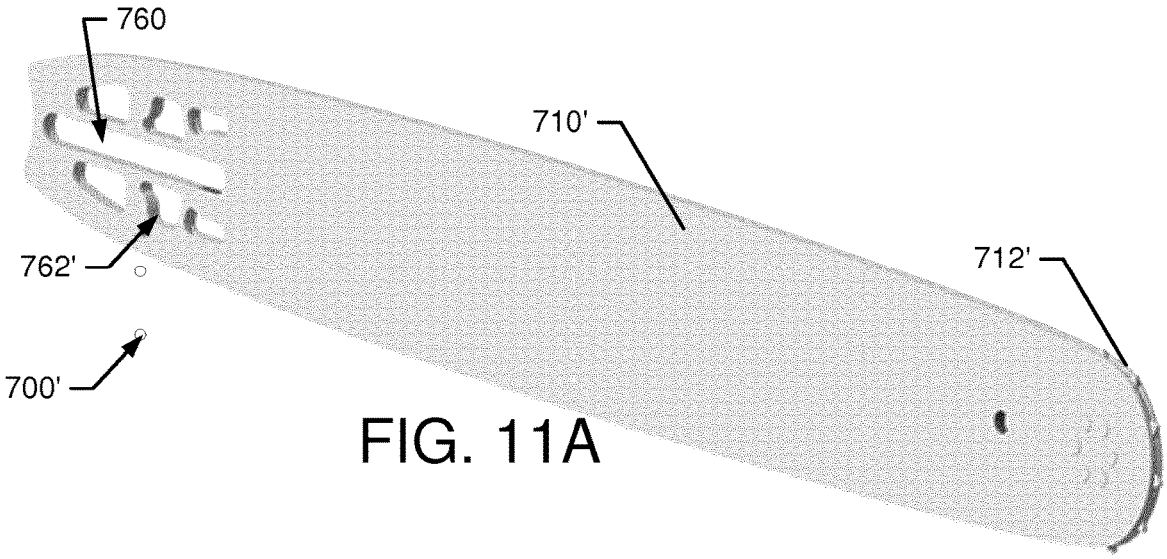
Figure 11B:
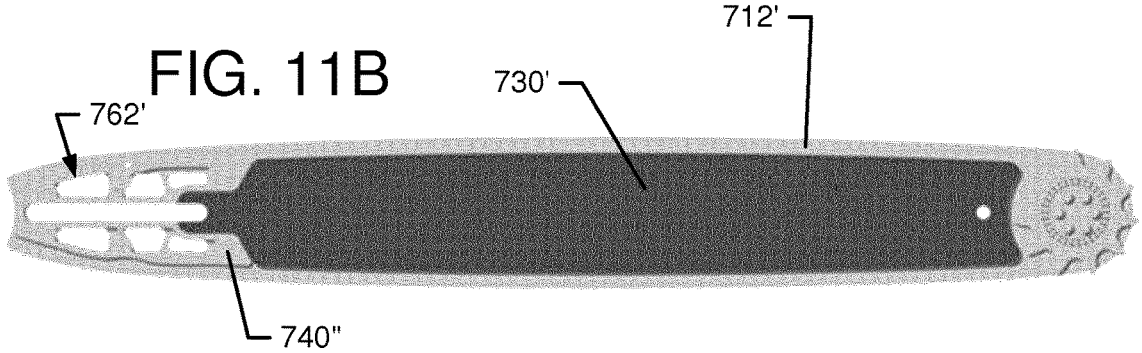
Figure 11C:
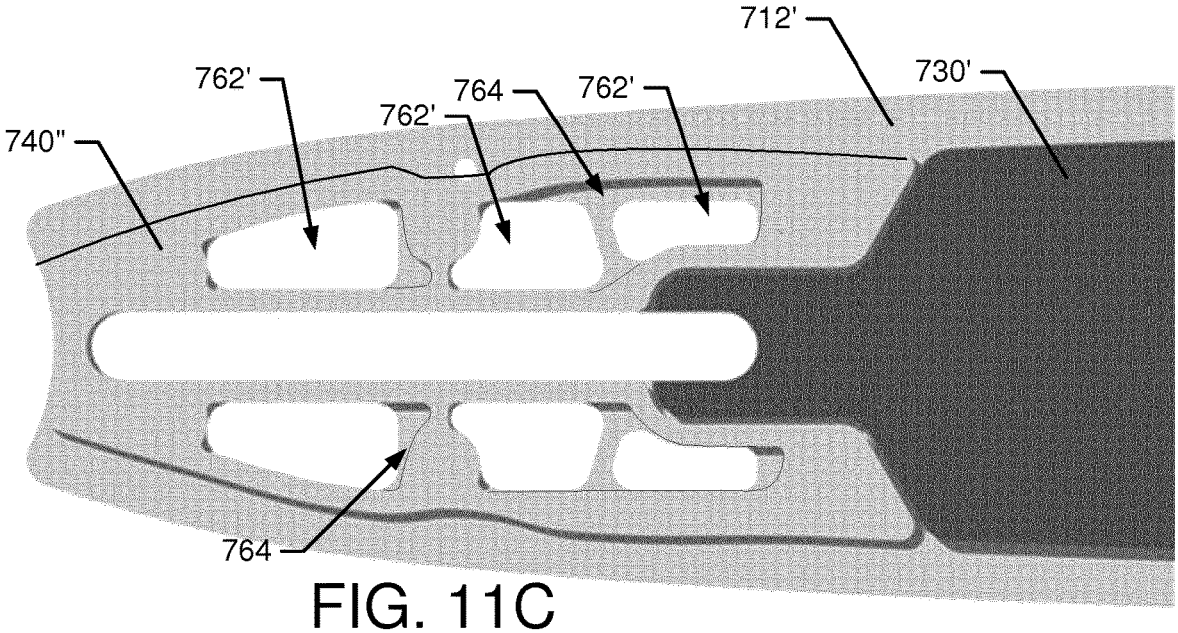
Figure 12:
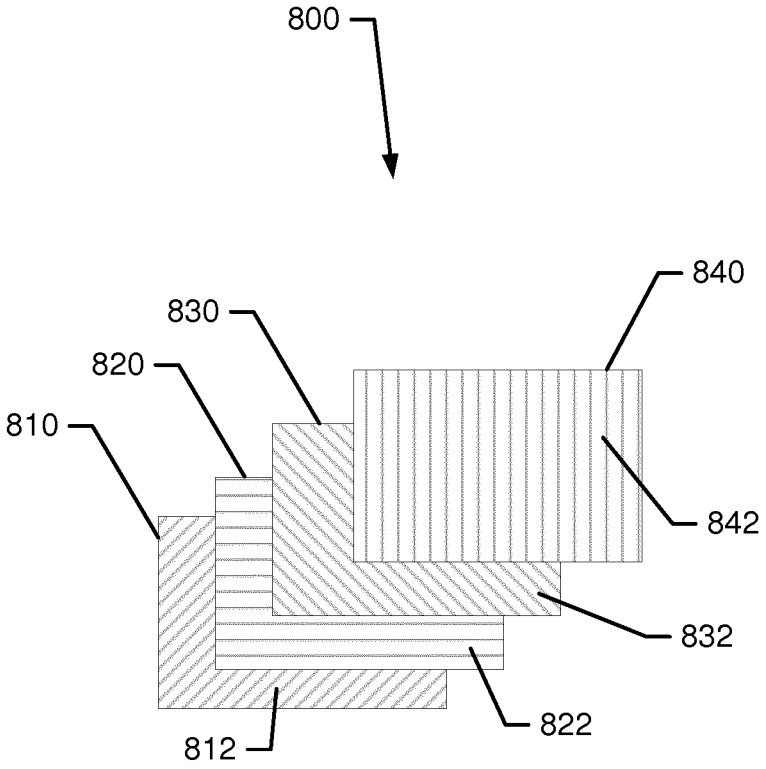

Having thus described some example embodiments in general terms, reference will now be made to the accompanying drawings, which are not necessarily drawn to scale, and wherein:

FIG. 1 illustrates a side view of a chainsaw according to an example embodiment;

FIG. 2 illustrates an exploded perspective view the guide bar in accordance with an example embodiment;

FIG. 3 illustrates a perspective view of an axial end (e.g., a forward portion or nose) of the guide bar of FIG. 1 in accordance with an example embodiment;

FIG. 4A illustrates a side view of the guide bar in accordance with an example embodiment;

FIG. 4B illustrates a cross section view taken along line A in FIG. 4A for a metallic core plate before punching to form a slot and orifices in accordance with an example embodiment;

FIG. 4C illustrates the same portion shown in FIG. 4B after punching to form the slot and the orifices in accordance with an example embodiment;

FIG. 5A illustrates a cross section of one possible guide bar that may be formed as a three dimensional structure in accordance with an example embodiment;

FIG. 5B illustrates a side view of the guide bar of FIG. 5A in accordance with an example embodiment;

FIG. 6A illustrates a cross section view of an alternative guide bar structure in accordance with an example embodiment;

FIG. 6B illustrates a side view of the guide bar of FIG. 6A showing non-metallic portions and metallic portions woven therein in accordance with an example embodiment;

FIG. 7 illustrates an example embodiment in which a laminate bar is provided with a heat barrier in accordance with an alternate example embodiment;

FIG. 8 illustrates an exploded perspective view of a lightweight guide bar in accordance with an example embodiment;

FIG. 9A illustrates a side view of an outside surface of a side plate in accordance with an example embodiment;

FIG. 9B illustrates a side view of an inside surface of the side plate in accordance with an example embodiment;

FIG. 9C illustrates an alternate base plate in accordance with an example embodiment;

FIG. 9D illustrates an insert in accordance with an example embodiment;

FIG. 9E illustrates a cross section view of the guide bar taken along line A-A' of FIG. 9A in accordance with an example embodiment;

FIG. 9F illustrates an alternative structure to that of FIG. 9E;

FIG. 9G illustrates another alternative structure to that of FIG. 9E and 9F;

FIG. 10A illustrates a side view of a guide bar with a different insert in accordance with an example embodiment;

FIG. 10B illustrates a side view of an alternate guide bar structure with another different insert in accordance with an example embodiment;

FIG. 10C illustrates a side view of a guide bar with still another different insert in accordance with an example embodiment;

FIG. 11A illustrates a perspective view of another alternative guide bar in accordance with an example embodiment;

FIG. 11B illustrates a side view of a second side plate of the guide bar in accordance with an example embodiment;

FIG. 11C illustrates a detailed side view of the insert of the guide bar of FIG. 10B in accordance with an example embodiment; and FIG. 12 illustrates a base plate made from multiple layers of material in accordance with an example embodiment.

DETAILED DESCRIPTION

Some example embodiments now will be described more fully hereinafter with reference to the accompanying drawings, in which some, but not all example embodiments are shown. Indeed, the examples described and pictured herein should not be construed as being limiting as to the scope, applicability or configuration of the present disclosure. Rather, these example embodiments are provided so that this disclosure will satisfy applicable legal requirements. Like reference numerals refer to like elements throughout. Furthermore, as used herein, the term "or" is to be interpreted as a logical operator that results in true whenever one or more of its operands are true. As used herein, operable coupling should be understood to relate to direct or indirect connection that, in either case, enables functional interconnection of components that are operably coupled to each other.

FIG. 1 illustrates side view of a chainsaw 100 according to an example embodiment. As shown in FIG. 1, the chainsaw 100 may include a housing 110 inside which a power unit or motor (not shown) is housed. In some embodiments, the power unit may be either an electric motor or an internal combustion engine. Furthermore, in some embodiments, the power unit may include more than one electric motor where one such electric motor powers the working assembly of the chainsaw 100 and the other electric motor of the power unit powers a pump that lubricates the working assembly or provides momentum for moving other working fluids within the chainsaw 100. The chainsaw 100 may further include a guide bar 120 that is attached to the housing 110 along one side thereof. A chain (not shown) may be driven around the guide bar 120 responsive to operation of the power unit in order to enable the chainsaw 100 to cut lumber or other materials. The guide bar 120 and the chain may form the working assembly of the chainsaw 100. As such, the power unit may be operably coupled to the working assembly to turn the chain around the guide bar 120.

The chainsaw 100 may include a front handle 130 and a rear handle 132. A chain brake and front hand guard 134 may be positioned forward of the front handle 130 to stop the movement of the chain 122 in the event of a kickback. In an example embodiment, the hand guard 134 may be tripped by rotating forward in response to contact with a portion of the arm (e.g., the hand/wrist) of the operator of the chainsaw 100. In some cases, the hand guard 134 may also be tripped in response to detection of inertial measurements indicative of a kickback.

The rear handle 132 may include a trigger 136 to facilitate operation of the power unit when the trigger 136 is actuated. In this regard, for example, when the trigger 136 is actuated (e.g., depressed), the rotating forces generated by the power unit may be coupled to the chain either directly (e.g., for electric motors) or indirectly (e.g., for gasoline engines). The term "trigger," as used herein, should be understood to represent any actuator that is capable of being operated by a hand or finger of the user. Thus, the trigger 136 may represent a button, switch, or other such component that can be actuated by a hand or portion thereof.

Some power units may employ a clutch to provide operable coupling of the power unit to a sprocket that turns the chain. In some cases (e.g., for a gasoline engine), if the trigger 136 is released, the engine may idle and application of power from the power unit to turn the chain may be stopped. In other cases (e.g., for electric motors), releasing the trigger 136 may secure operation of the power unit. The housing 110 may include a fuel tank for providing fuel to the power unit. The housing 110 may also include or at least partially define an oil reservoir, access to which may be provided to allow the operator to pour oil into the oil reservoir. The oil in the oil reservoir may be used to lubricate the chain as the chain is turned.

As can be appreciated from the description above, actuation of the trigger 136 may initiate movement of the chain around the guide bar 120. A clutch cover 150 may be provided to secure the guide bar 120 to the housing 110 and cover over the clutch and corresponding components that couple the power unit to the chain (e.g., the sprocket and clutch drum). As shown in FIG. 1, the clutch cover 150 may be attached to the body of the chainsaw 100 (e.g., the housing 110) via nuts 152 that may be attached to studs that pass through a portion of the guide bar 120. The guide bar 120 may also be secured with the tightening of the nuts 152, and a tightness of the chain can be adjusted based on movement of the guide bar 120 and subsequent tightening of the nuts 152 when the desired chain tightness is achieved. However, other mechanisms for attachment of the clutch cover 150 and/or the guide bar 120 may be provided in other embodiments including, for example, some tightening mechanisms that may combine to tighten the chain in connection with clamping the guide bar 120.

As mentioned above, the guide bar 120 can be an important contributor to the weight of the chainsaw 100. Thus, it may be desirable to provide various improvements to the guide bar 120 to improve the functionality and/or decrease the weight of the guide bar 120. Various example embodiments will now be described in reference to FIGS. 2-7, which illustrate some of these example embodiments.

In this regard, FIG. 2 illustrates an exploded perspective view the guide bar 120 in accordance with an example embodiment. Referring to FIG. 2, it can be appreciated that the guide bar 120 may be formed from multiple laminate core sheets that lie in parallel planes along side each other. These laminate core sheets may be made from stainless steel and other sufficiently rigid and durable materials. As mentioned above, because steel and other metallic materials tend to have increased weight, some example embodiments may minimize the use of steel and may instead only use steel in certain strategically important locations. Other materials of a lower weight (e.g., graphene, glass fiber, carbon fiber, or the like) may be employed at remaining portions of the guide bar 120.

In this example, a first side plate 200 and a second side plate 210 may form outer portions or surfaces of the guide bar 120. The first and second side plates 200 and 210 may generally be spaced apart from each other be at least a certain distance, which may be substantially consistent over the lengths of the first and second side plates 200 and 210. The consistent spacing between the first and second side plates 200 and 210 may be maintained by the existence of other plates. In an example embodiment, a first metallic (e.g., steel) core plate 220 and a second metallic core plate 230 may be included proximate to each of the first and second side plates 200 and 210, respectively. However, the first and second metallic core plates 220 and 230 may also be spaced apart from each other. The spacing between the first and second metallic core plates 220 and 230 may be maintained by a base plate 240.

The base plate 240 and each of the first and second side plates 200 and 210 may be made of a relatively low weight, non-metallic material such as graphene, glass fiber, carbon fiber, or the like. As can be appreciated from FIG. 2, the base plate 240 and each of the first and second side plates 200 and 210 may also be relatively thin, plate-like sheets of the non-metallic material provided to lie in parallel planes. In an example embodiment, the first and second metallic core plates 220 and 230 may also be relatively thin, plate-like sheets of metallic material that lie in parallel planes. However, while the base plate 240 and each of the first and second side plates 200 and 210 are substantially continuously filled inside their respective perimeters, the first and second metallic core plates 220 and 230 may have substantially hollowed out interior portions to further lessen the weight of the guide bar 120. Moreover, although the first and second side plates 200 and 210 and the base plate 240 may be substantially filled inside their respective peripheries in some cases, the base plate 240 may be provided with one or more cutout portions at an interior region thereof in some examples.

In this regard, each of the laminate core sheets may have a slot 250 formed therein. The slot 250 may be provided (e.g., punched, etched, milled, or otherwise formed) at a portion of the guide bar 120 that is opposite the nose of the guide bar 120, and the slot 250 may be part of the guide bar to chainsaw interface. Thus, for example, the nuts 152 of FIG. 1 may pass through the slot 250 to enable the guide bar 120 to be affixed to the chainsaw 100. Additional orifices 252 may also be provided proximate to the slot 250 (e.g., above and below the slot 250) to further support the guide bar to chainsaw interface or functions associated therewith.

As shown in FIG. 2, the first and second side plates 200 and 210 may also have nose sprocket openings 254 formed proximate to the nose of the guide bar 120. The nose sprocket openings 254 may be shaped to accommodate a nose sprocket protrusion 256 provided (e.g., formed or otherwise added later on via welding or other joining mechanisms) on each of the first and second metallic core plates 220 and 230. Of note, although the nose sprocket protrusion 256 is shown in FIG. 2 as having a generally circular shape, the nose sprocket protrusion 256 could alternatively have other shapes. For example, the nose sprocket protrusion 256 could have an oval shape, an elongated oval shape, or other suitable shapes extended along one direction (e.g., along a direction parallel to a longitudinal direction of extension of the guide bar 120) to facilitate reinforcement that prevents pinching of the nose sprocket 280.

The nose sprocket protrusions 256 may face outward and protrude through the nose sprocket openings 254, fitting relatively tightly therein. Meanwhile, the base plate 240 may terminate before reaching the nose of the guide bar 120 in order to leave a gap between the first and second metallic core plates 220 and 230 where the nose sprocket can be rotatably fixed. A nose sprocket 280 is shown in FIG. 3 and is provided in a channel 285 formed between the first and second metallic core plates 220 and 230. The nose sprocket 280 (or sprocket wheel) may be rotatable to interface with the cutting chain as the cutting chain turns around the axial end of the guide bar 120. The nose sprocket 280 may be supported by a bearing assembly (not shown). In some cases, the nose sprocket 280 may be a replaceable nose sprocket 280. Thus, some bars may be provided with or without a replaceable nose sprocket.

The provision of extra steel in the form of the nose sprocket protrusion 256 may reinforce the strength of the guide bar 120 in the vicinity of the nose sprocket 280 and increase resistance to pinching of the nose sprocket 280. The provision of the nose sprocket protrusion 256 may also increase the resilience of the interface between the first and second side plates 200 and 210 and the first and second metallic core plates 220 and 230, respectively. In this regard, for example, the laminated layers may be less likely to delaminate or separate when the guide bar 120 is stressed during cutting operations or other activities that may stress the guide bar 120.

The first and second metallic core plates 220 and 230 may, as mentioned above, be substantially hollowed out inside their periphery to reduce the weight of the guide bar 120. In this regard, each of the first and second metallic core plates 220 and 230 may include a perimeter portion 260, an interior framework 262 and gaps 264. The perimeter portion 260 may extend around an entirety of the periphery of each respective one of the first and second metallic core plates 220 and 230. Meanwhile, the interior framework 262 may be provided to extend inside the periphery of the first and second metallic core plates 220 and 230 to support the perimeter portion 260. The perimeter portion 260 and the interior framework 262 may also combine to maintain spacing between the base plate 240 and each of the first and second side plates 200 and 210.

The gaps 264 formed in the first and second metallic core plates 220 and 230 may be laser cut, etched, punched out or otherwise removed pieces of material from sheet metal or another metallic sheet of material. The orifice 252 and the slot 250 may also be formed in the same manner, and at the same time. Alternatively, the orifice 252 and the slot 250 may formed in separate operations. In any case, the removal of material to form the gaps 264 may reduce the overall weight of the guide bar 120 without sacrificing strength and rigidity.

FIG. 4A illustrates a side view of the guide bar 120 in accordance with an example embodiment. FIG. 4B illustrates a cross section view taken along line A for one of the first or second metallic core plate 220 or 230 before punching to form the slot 250 and orifices 252. FIG. 4C illustrates the same portion after punching to form the slot 250 and the orifices 252. The punching (or otherwise forming) of the slot 250 and the orifices 252 provides such openings in a steel (or metallic) sheet so that, when formed as the first or second metallic core plate 220 or 230, the steel sheet can provide reinforcement for the strength of the guide bar 120 at the interface region where the guide bar 120 interfaces with the housing 110 of the chainsaw 100. The lifetime and durability of both the guide bar 120 and the chainsaw 100 may therefore be improved.

In some cases, the first and second metallic core plates 220 and 230 may be formed to extend over portions of the periphery of the first and second side plates 200 and 210. For example, the first and second metallic core plates 220 and 230 may be formed to extend over portions of the periphery of the first and second side plates 200 and 210 at locations of the guide bar 120 that are used for cutting (e.g., portions other than the nose of the guide bar 120 and the interface between the guide bar 120 and the housing 110. FIG. 3 shows extension portions 222 and 232 that wrap around the periphery of the first and second side plates 200 and 210 only along the longitudinal edges thereof (i.e., not at the nose of the guide bar 120). By making the first and second metallic core plates 220 and 230 extend over the periphery of the first and second side plates 200 and 210 at cutting locations of the guide bar 120, the parts of the guide bar 120 that interface with the chain (which is made of metal) under cutting stress can be more wear resistant. The channel 285, visible in FIG. 3, can be surrounded by metal in the cutting regions of the guide bar 120. However, the nose of the guide bar 120 is generally not used for cutting, and therefore weight advantage can be gained by not extending the first and second metallic core plates 220 and 230 over the periphery of the first and second side plates 200 and 210 at the nose of the guide bar 120. The extension portions 222 and 232 therefore effectively form a metallic chain track for the guide bar 120. In some cases, the chain track (e.g., the extension portions 222 and 232) could be treated or coated for additional wear resistance property enhancement. Other portions of the first and second metallic core plates 220 and 230 that experience wear due to moving parts may also be treated or coated. For example, portions of the first and second metallic core plates 220 and 230 that are proximate to the nose sprocket 280 (e.g., interior portions of the first and second metallic core plates 220 and 230) may also be treated or coated to increase wear resistance.

Accordingly, it should be appreciated that the first and second side plates 200 and 210 and the first and second metallic core plates 220 and 230 may be substantially equal in longitudinal length, but the base plate 240 may be shorter. Meanwhile, the first and second metallic core plates 220 and 230 may be slightly longer (to provide the extension portions 222 and 232) than the first and second side plates 200 and 210 and the base plate 240 in the transverse (or height) direction.

When combined, the first and second side plates 200 and 210, the first and second metallic core plates 220 and 230, and the base plate 240 may form a light weight, but still rigid and durable guide bar 120. As indicated above, the metallic portions of the guide bar 120 may be strategically located (and/or treated/coated) to improve wear resistance. Additional features may also be provided to inhibit the possibility of delaminating, and the plates can be joined together by adhesives, or by curing of the whole product or parts of the product materials. Interfaces between materials that could cause galvanic corrosion (e.g., carbon fiber and steel) may be protected with adhesives or other materials that are designed to hinder galvanic corrosion. However, in other cases, the plates may be joined together in other ways.

In this regard, for example, in some cases, the guide bar 120 may be formed from the different materials and plates described above as a three dimensional structure that is joined together. Three dimensional formation of the guide bar 120 may be accomplished, for example, by injection molding or by creating a woven molded fiber structure including the non-metallic components, and then inserting the metallic components therein. Thus, for example, the first and second side plates 200 and 210 may be woven together or injection molded together (with or without the base plate 240) and the first and second metallic core plates 220 and 230 may be inserted into the resultant structure from one of the longitudinal ends of the resultant structure to form the guide bar 120. FIG. 5A illustrates a cross section of one possible guide bar 400 that may be formed in this manner, and FIG. 5B illustrates a side view of the guide bar 400. The guide bar 400 may include non-metallic portions 410 and metallic portions 420. In the context of FIG. 5B, the dashed lines illustrate internally located steel portions, FIG. 6A illustrates a cross section view of the structure of an alternative guide bar 500. FIG. 6B illustrates a side view of the guide bar 500 showing non-metallic portions 510 and metallic portions 520. The steel or metallic portions are joined in an extra step after the remainder of the structure is woven or injection molded with glass fiber, carbon fiber, graphene and/or the like.

When a guide bar is produced to have reduced weight, it should be appreciated that thermal stresses associated with usage of the guide bar may also impact the possibility of delaminating by allowing heat to transmit down the guide bar and influence adhesion or otherwise cause changes to material properties. Some materials that can be impacted by temperature increase could be considered to be unusable even though they would otherwise work well for weight reduction and rigidity purposes in the absence of high temperature concerns. To avoid or mitigate such impacts, and to allow a greater variety of materials to be considered to be usable, it may be desirable to insulate the guide bar from temperature increases in some way. FIG. 7 illustrates an example embodiment in which a laminate bar is provided with a heat barrier.

As shown in FIG. 7, a laminate bar 600 may be provided with similar construction to that described above. However, an interface region 610, where the housing 110 of the chainsaw 100 overlaps with the guide bar, a heat barrier 630 may be employed. The working portion 620 of the laminate bar 600 may extend from the interface region 610 to the nose of the laminate bar 600, and may not include the heat barrier 630.

The heat barrier 630 may be located on the chainsaw 100 (e.g., on an inner portion of the clutch cover 150 (see FIG. 1)), or may be provided as a separate part to be inserted between the clutch cover 150 and the laminate bar 600 at the interface region 610. In still other examples, the heat barrier 630 may coat the laminate bar 600 or be joined to the laminate bar 600 at the interface region 610 to cover the interface region 610. The heat barrier 630 may be a ceramic material or another material with a low thermal conductivity. However, in other embodiments, the heat barrier 630 may be a structure (or structures) configured as a three dimensional structured surface to reduce contact area between the chainsaw 100 and the laminate bar 600 at the interface region 610. In other examples, the material of the heat barrier 630 may be such that the interface between the chainsaw 100 and the laminate bar 600 is changed in such a way as to facilitate heat dissipation away from the laminate bar 600 and prevent heat transfer through the laminate bar 600.

In other example embodiments, the side and/or core plates may be milled or molded to have cavities formed to receive a middle plate that is made of a low weight and/or high stiffness material in such a way that the middle plate defines a width for the channel inside which the chain rides. FIG. 8 illustrates an exploded perspective view of a lightweight guide bar 700 in accordance with an example embodiment. The guide bar 700 is formed from a first side plate 710 and a second side plate 712. The first and second side plates 710 and 712 may each be made of steel, or another rigid, metallic material and/or non-metallic materials in any combination. Thus, for example, the first and second side plates 710 and 712 may correlate to the core plates in combination with the side plates discussed above, or just the core plates, or just the side plates. Regardless of which components described previously the first and second side plates 710 and 712 may correlate to, each of the first side plate 710 and second side plate 712 may be formed to have a substantially smooth and/or flat outer surface (facing away from each other), while having inner surfaces (facing each other) that include recessed portions (e.g., recessed portions 720 (see FIG. 9E)

and 722) that also face each other. The recessed portion 722 may be milled out of the second side plate 712 or may be formed in the second side plate 712 when the second side plate 712 is formed.

A base plate 730 may be formed to substantially match a shape of the recessed portions 720 and 722 to substantially fill the space formed by the recessed portions 720 and 722 and define a width (W1) of a channel 750 inside which the chain rides around the guide bar 700. The base plate 730 may be made from non-metallic, lower weight material (e.g., graphene, glass fiber, carbon fiber, or the like). By replacing the higher weight steel or metallic material of a typical guide bar with the base plate 730 at interior portions of the guide bar 700, the overall weight of a chainsaw employing the guide bar 700 may be reduced. The base plate 730 may be affixed to the first and second side plates 710 and 712 by an adhesive.

FIG. 9, which is defined by FIGS. 9A, 9B, 9C, 9D, 9E, 9F and 9G, illustrates several aspects of the guide bar 700 in greater detail. In this regard, FIG. 9A illustrates a side view of an outside surface of the second side plate 712, while FIG. 9B illustrates a side view of an inside surface of the second side plate 712. Of note, the recessed portion 722 of the second side plate 712 of FIG. 9B is partially filled with an insert 740. The insert 740 is configured to mate with an alternate base plate 730' (see FIG. 9C) to substantially fill the void space formed when the first and second side plates 710 and 712 are joined with the base plate 730' and the insert 740. The base plate 730' is shown in greater detail in FIG. 9C, while the insert 740 is shown in isolation in FIG. 9D. A cross section view of the guide bar 700 taken along line A-A' of FIG. 9A is shown in FIG. 9E.

It should be noted that although the base plates 730 and 730' are each shown as substantially unitary structures without any through holes therethrough, it may be possible to remove some material from the base plates as well to reduce weight and material requirements. In such examples, portions of sides of the base plates 730 and 730' may be removed while leaving a lattice structure for support. The portions removed may extend all the way through the width of the base plates 730 and 730' or may be formed such that they do not pass all the way through the base plates 730 and 730'. It may also be possible to form the base plates 730 and 730' from individual pieces that can be joined together or otherwise placed proximate to each other during assembly.

As mentioned above, the base plate 730 may be configured to fit substantially all of the void space created by the recess portions 720 and 722. Meanwhile, the alternate base plate 730' may be shaped to fit substantially all of the void space except that which is filled by the insert 740. The insert 740 may be employed at the proximal end of the guide bar 700 relative to the housing 110. In this regard, for example, the insert 740 may be disposed at a portion of the guide bar 700 that is covered by the clutch cover 150. The clutch cover 150 may inhibit heat dissipation at portions of the guide bar 700 that are disposed between the clutch cover 150 and the housing 110 (see FIG. 1). As such, since some adhesives may tend to degrade in the presence of excessive heat, the use of the insert 740 may enable welding or riveting to be used to join the insert 740 and the first and second side plates 710 and 712 so that any adhesive is generally used where sufficient heat dissipation can occur to avoid adhesive degradation. At other portions of the guide bar 700, the base plate 730' may be joined to the first and second side plates 710 and 712 via adhesive. In some cases, a thermal barrier may be provided between the insert 740 and the base plate 730'.

In some examples, the insert 740 may include a receiving slot 742 configured to receive a projection 732 formed on the proximal end of the base plate 730'. The receiving slot 742 may be formed between respective arms 744 of the insert 740. The arms 744 may project toward a distal end of the guide bar 700 and, in some cases, may extend beyond the point at which the clutch cover 150 would cease to cover the guide bar 700. The receiving slot 742 may extend all the way to a slot 760 formed in the guide bar 700 to allow the nuts 152 to pass therethrough for chain tension to be adjusted by lateral movement of the guide bar 700 forward or rearward relative to the nuts 152 (see FIG. 1). Thus, the projection 732 may extend rearward (i.e., toward the proximal end of the guide bar 700) to the slot 760. The slot 760 may also be formed into both of the first and second side plate 710 and 712. The use of steel for the insert 740 may allow improved handling of mechanical stress, as well as handling of thermal stress.

In examples with the base plate 730, the slot 760 may be formed to pass through the base plate 730 as well. Additionally, when other through holes 762 are employed in the first and second side plates 710 and 712, such through holes 762 may also be formed in either the base plate 730, or if the base plate 730' is employed, the through holes 762 may be formed in the insert 740. However, in some examples (see FIG. 10A), a base plate 730" may be employed that accommodates smaller inserts 740' that only surround the through holes 762. In this example as well, the through holes 762 may be located at an area that sees relatively high heat production. Moreover, since the slot 760 has some open space to facilitate heat dissipation, and the area proximate to the through holes 762 can be separate from the slot 760, it may be desirable to provide steel or other metallic material that can be welded or riveted (instead of using adhesives) proximate to the through holes 762. FIG. 10B shows an alternative in which the inserts 740" inside which the through holes 762 are formed are much larger, and FIG. 10C illustrates a one piece insert 740' inside which the slot 760 and the through holes 762 may be formed.

As can be appreciated from FIG. 9E, a width (W2) of the base plate 730' may be larger than the width (W1) of the channel 750. However, the width (W2) of the base plate 730' effectively defines the width (W1) of the channel 750. In this regard, a width (W3) of the guide bar 700 may be equal to the width (W2) of the base plate 730' plus a width (W4) of each of the side plates 710 and 712 proximate to the recess portions 720 and 722. As such, the width (W3) of the guide bar 700 may also be equal to the width (W1) of the channel 730' plus a width (W5) of each of the side plates 710 and 712 at portions thereof that are not proximate to the recess portions 720 and 722. FIG. 9E further demonstrates that metal does not contact metal in this example over a majority of the length of the guide bar 700. Moreover, the first and second side plates 710 and 712 do not contact each other at all. Instead, metal only contacts other metal at portions where the insert 740 or 740' is employed. And at such locations, the first side plate 710 would be joined to the insert 740 or 740' (e.g., using adhesives, riveting or welding), and then the insert 740 or 740' would be joined to the second side plate 712. If welding is employed, in some cases, all three components could be welded in a single operation through one of the side plates.

Alternate structures to that of FIG. 9E are also possible. For example, FIG. 9F illustrates an example that is substantially identical to the example of FIG. 9E except that the recess portions 720 and 722 are not formed by milling, but are instead formed by using first and second side plates 710' and 712' that are formed from separate portions including, for example, base portions 711 and perimeter portions 713. The perimeter portions 713 may have substantially the same shape as the base portions 711, but may be hollowed out at their centers with the hollowed out portion substantially matching a shape of the base plate 730'. The perimeter portions 713 may be attached to their respective base portions 711 by welding, riveting, adhesives, soldering and/or the like. As yet another alternative (shown in FIG. 9G), the base plate 730" may extend all the way through the first and second side plates 710" and 712". Thus, the first and second side plates 710" and 712" extend around a periphery of the base plate 730".

As shown in FIGS. 8-10, the slot 760 and through holes 762 may be the only holes formed through the proximal end of the first and second side plates 710 and 712 in some cases. Moreover, the inclusion of material, whether metallic or non-metallic, proximate to the slot 760 and through holes 762 may be continuously provided. However, in some examples, it may be desirable to remove some more of the metallic material of the guide bar, particularly in regions that are not visible due to coverage of the clutch cover 150 (see FIG. 1).

Accordingly, yet another alternative embodiment may be provided in which portions of the side plates are removed to further lighten the guide bar. In this regard, an alternative guide bar 700' is shown in FIG. 11, which is defined by FIGS. 11A, 11B and 11C. FIG. 11A illustrates a perspective view of the guide bar 700' in accordance with an example embodiment. The guide bar 700' includes first and second side plates 710' and 712' that are similar to the first and second side plates 710 and 712 described above except that they include more material removed at the proximal end of the guide bar 700'. The additional material removed from the first and second side plates 710' and 712' results in the formation of more numerous and larger through holes 762', which can have irregular shapes. These through holes 762' may create a reinforcing metallic lattice of material that keeps strength high, but the removal of material lightens the overall weight of the guide bar 700'. It should also be appreciated that this strategy may be employed in connection with the examples described above in reference to FIGS. 2-7.

FIG. 11B illustrates a side view of the second side plate 712' in accordance with an example embodiment, and FIG. 11C illustrates a similar side view except that it provides a more detailed view of the region in which the through holes 762' are formed (i.e., the proximal end of the guide bar 700'). As shown in FIGS. 11B and 11C, the through holes 762' formed in the second side plate 712' may not match exactly with through holes 764 formed in insert 740". The insert 740" may therefore be similar in shape to the insert 740 described in reference to FIG. 9, except that the insert 740" includes the through holes 764 formed therethrough. Although the through holes 764 could be formed to match the shape and position of the through holes 762' formed in the side plates, more material could be removed in the insert 740" to further lighten the guide bar 700'. In this example, multiple through holes 762' of the side plates may correspond to a single through hole 764 of the insert 740" in at least one instance, and one through hole 762' may be provided to correspond to at least one through hole 764 of the insert 740" in at least another instance. However, it could be the case that more than one through holes 762' of the side plates corresponds to a single through hole 764 of the insert 740" in all instances in an alternative embodiment. Similarly, it could be the case that only one through hole 762' is provided to correspond to each individual through hole 764 of the insert 740" in another alternative embodiment. The shapes of such holes may be either the same or different as well in various example embodiments.

In some examples, the base plate (240, 730, 730') may be made from a single layer of woven material or unidirectional fiber. However, in other examples, the base plate itself may be made from multiple layers of material. As such, an example base plate 800 is shown in FIG. 12. The base plate 800 may be an example that may be used as a replacement for a base plate with a single layer of unidirectional fibers that may be used in connection with any of the examples described above.

As shown in FIG. 12, the base plate 800 may include a first layer 810, a second layer 820, a third layer 830 and a fourth layer 840. However, it should be appreciated that more layers (e.g., seven) or fewer layers (e.g., 2 or 3) could be used in alternative embodiments. When multiple layers are used, the layers may be laminated together to form the base plate 800 and may be joined by adhesives or any other suitable joining method. Although in some cases, each of the first layer 810, the second layer 820, the third layer 830 and the fourth layer 840 may be formed to have fibers that have the same orientation, it may be desirable to employ layers with different fiber orientations in alternative embodiments. Thus, for example, as shown in FIG. 12, the first layer 810 may have fibers 812 having a first fiber direction, while the second layer 820 has fibers 822 having a second fiber direction, the third layer 830 has fibers 832 having a fourth fiber direction, and the fourth layer 840 has fibers 842 having a fourth fiber direction. Each of the first fiber direction, the second fiber direction, the third fiber direction and the fourth fiber direction may be different from each other. However, in some cases, it may be desirable to repeat layers with similar fiber directions.

As can be appreciated from FIG. 12, the second fibers 822 may be arranged to extend along the longitudinal length of the guide bar. Thus, the second fibers 822 may be as long as (or nearly as long as) the length of the guide bar. Meanwhile, the fourth fibers 842 may be arranged to extend substantially perpendicular to the direction of extension of the second fibers 822. Thus, the fourth fibers 842 may be substantially shorter than the second fibers 822. Moreover, the fourth fibers 842 may be shorter than the width of the guide bar. The first fibers 812 and the third fibers 832 may be provided at some angle in between the directions of extension of the second fibers 822 and the fourth fibers 842, and therefore may have lengths in between the lengths of the second fibers 822 and the fourth fibers 842. In some cases, the first fibers 812 may extend to form an angle between 0 degrees to 90 degrees relative to the direction of extension of the second fibers 822.

A chainsaw of an example embodiment may therefore include a power unit and a working assembly powered responsive to operation of the power unit. The working assembly includes a guide bar around which a chain is rotatable. The guide bar includes a laminated structure in which different ones of the layers of the laminated structure are comprised of different materials.

In some embodiments, additional optional features may be included or the features described above may be modified or augmented. Each of the additional features, modification or augmentations may be practiced in combination with the features above and/or in combination with each other. Thus, some, all or none of the additional features, modifications or augmentations may be utilized in some embodiments. For example, in some cases, the guide bar may include a first side plate and a second side plate facing each other and extending away from the housing to a nose of the guide bar, where the first and second side plates being formed of a non-metallic material. The guide bar may further include a first metallic core plate and a second metallic core plate facing each other and adjacent to respective ones of the first and second side plates, and a base plate disposed between the first and second metallic core plates. In an example embodiment, the first and second side plates may be woven or injection molded as a three dimensional structure, and the first and second metallic core plates may be inserted therein in a separate step. In some cases, the base plate may be woven with the first and second side plates. In an example embodiment, the guide bar may include a heat barrier disposed at an interface region where the guide bar interfaces with the housing. In some cases, the first and second metallic core plates may extend over at least a portion of a periphery of the first and second side plates to define a metallic chain track. In some embodiments, the first and second side plates each comprise a nose sprocket opening formed proximate to a nose of the guide bar. The nose sprocket openings may be shaped to receive a respective nose sprocket protrusion provided on each of the first and second metallic core plates. In an example embodiment, the first and second side plates and the base plate are each formed of glass fiber, graphene, or carbon fiber. In some embodiments, the first and second metallic core plates each include a perimeter portion, an interior framework and gaps punched therebetween. In an example embodiment, the first and second metallic core plates may each include a slot and one or more orifices may be provided therein at an interface region where the guide bar mates with the housing. In some cases, an insert may be disposed between the first and second side plates at a proximal end of the guide bar. In an example embodiment, the insert may be welded or riveted to each of the first and second side plates. In some embodiments, the base plate may include multiple laminated layers of carbon fiber material. In such an example, fibers in at least one of the layers have a different orientation than fibers of another layer. Alternately or additionally, the fibers of the at least one of the layers are substantially orthogonal to the fibers of the another layer. Alternately or additionally, fibers in at least one of the layers may have an angle of orientation between about 0 degrees and 90 degrees different than fibers of another layer. In an example embodiment, a width of the base plate may be greater than a width of a channel in which the chain moves around the guide bar.

Many modifications and other embodiments of the inventions set forth herein will come to mind to one skilled in the art to which these inventions pertain having the benefit of the teachings presented in the foregoing descriptions and the associated drawings. Therefore, it is to be understood that the inventions are not to be limited to the specific embodiments disclosed and that modifications and other embodiments are intended to be included within the scope of the appended claims. Moreover, although the foregoing descriptions and the associated drawings describe exemplary embodiments in the context of certain exemplary combinations of elements and/or functions, it should be appreciated that different combinations of elements and/or functions may be provided by alternative embodiments without departing from the scope o appended claims. In this regard, for example, different combinations of elements and/or functions than those explicitly described above are also contemplated as may be set forth in some of the appended claims. In cases where advantages, benefits or solutions to problems are described herein, it should be appreciated that such advantages, benefits and/or solutions may be applicable to some example embodiments, but not necessarily all example embodiments. Thus, any advantages, benefits or solutions described herein should not be thought of as being critical required or essential to all embodiments or to that which is claimed herein. Although specific terms are employed herein, they are used in a generic and descriptive sense only and not for purposes of limitation.

The invention claimed is:

1. A guide bar for guiding a chain of a chainsaw, the guide bar being operably coupled to a housing of the chainsaw, the guide bar comprising:

a laminated structure comprising a first laminate core sheet, a second laminate core sheet, and a third laminate core sheet in which at least one of the first, second and third laminate core sheets of the laminated structure is comprised of different material than another one of the first, second and third laminate core sheets; and a first side plate forming the first laminate core sheet and a second side plate forming the second laminate core sheet, the first and second side plates facing each other and extending away from the housing to a nose of the guide bar, wherein each of the first, second and third laminate core sheets lie in parallel planes alongside each other, wherein the third laminate core sheet comprises a base plate, wherein a width of the base plate is greater than a width of a channel in which the chain moves around the guide bar, wherein the first and second side plates do not contact each other, and wherein the first and second side plates are each formed of a base portion and a perimeter portion to define a recess inside which the base plate is disposed, the perimeter portion extending around a periphery of the base plate.

2. The guide bar of claim 1, further comprising an insert is disposed between the first and second side plates at a proximal end of the guide bar, and wherein the insert is welded, glued, soldered or riveted to each of the first and second side plates, and wherein the insert forms the third laminate core sheet.

3. The guide bar of claim 1, wherein the third laminate core sheet comprises a base plate, and wherein the base plate comprises multiple laminated layers of carbon fiber, glass fiber, polymer or other light material.

4. The guide bar of claim 3, wherein fibers in at least one of the layers have a different orientation than fibers of another layer.

5. The guide bar of claim 4, wherein the fibers of the at least one of the layers are substantially orthogonal to the fibers of the another layer.

6. The guide bar of claim 1, wherein the first and second side plates do not contact each other, and wherein the first and second side plates are each formed to extend around a periphery of the base plate.

7. The guide bar of claim 1, wherein at least a portion of the guide bar further comprises a surface treatment or coating configured to reduce friction or wear.

* * * * *